US009016203B2

(12) United States Patent
Baumann et al.

(10) Patent No.: US 9,016,203 B2
(45) Date of Patent: Apr. 28, 2015

(54) PROPELLANT CHARGE IGNITER

(75) Inventors: Christian Baumann, Martinsrieth (DE); Thomas Heitmann, Unterlüß (DE); Klaus-Achim Kratzsch, Hermannsburg (DE)

(73) Assignee: Rheinmetall Waffe Munition GmbH, Unterlüss (DE)

( * ) Notice: Subject to any disclaimer, the term of this patent is extended or adjusted under 35 U.S.C. 154(b) by 109 days.

(21) Appl. No.: 12/674,653

(22) PCT Filed: Jul. 25, 2008

(86) PCT No.: PCT/EP2008/006106
§ 371 (c)(1),
(2), (4) Date: Feb. 22, 2010

(87) PCT Pub. No.: WO2009/024243
PCT Pub. Date: Feb. 26, 2009

(65) Prior Publication Data

US 2011/0259225 A1 Oct. 27, 2011

(30) Foreign Application Priority Data

Aug. 22, 2007 (DE) ..... 10 2007 039 662

(51) Int. Cl.
*F23Q 7/00* (2006.01)
*F42C 19/08* (2006.01)

(52) U.S. Cl.
CPC ..... *F42C 19/0826* (2013.01)

(58) Field of Classification Search
USPC ..... 102/470, 469, 202, 472, 471
See application file for complete search history.

(56) References Cited

U.S. PATENT DOCUMENTS

| | | | | |
|---|---|---|---|---|
| 3,182,595 | A | 5/1965 | Hassmann | |
| 5,052,302 | A | 10/1991 | Taddeo et al. | |
| 5,335,600 | A * | 8/1994 | Horr et al. | 102/470 |
| 5,398,533 | A * | 3/1995 | Shimanovski et al. | 72/55 |
| 5,895,881 | A | 4/1999 | Thiesen et al. | |
| 6,857,370 | B1 * | 2/2005 | May | 102/470 |

FOREIGN PATENT DOCUMENTS

| | | |
|---|---|---|
| DE | 2553717 | 11/1975 |
| DE | 3512942 A1 | 10/1986 |
| DE | 3701145 A1 | 8/1987 |

(Continued)

OTHER PUBLICATIONS

International Search Report in International Application No. PCT/EP2008/006106, dated Dec. 30, 2008.

(Continued)

*Primary Examiner* — Troy Chambers
(74) *Attorney, Agent, or Firm* — Griffin & Szipl, P.C.

(57) ABSTRACT

The invention relates to producing a propellant charge igniter tube (2) for a propellant charge igniter (1) by means of hydroforming (high-pressure forming). According to the present invention, a sleeve base (6) is then joined to the propellant charge igniter tube (2) by means of friction welding, for example, and vulcanized without reworking. In this context, the rubber lips of the sleeve base (6) and the propellant charge igniter tube (2) are molded on, or vulcanized, on in one operation. The vacuum-packed benites (8) and the lower part (9) of the propellant charge igniter (1) can then be mounted in the sleeve base (6).

10 Claims, 4 Drawing Sheets

(56) References Cited

FOREIGN PATENT DOCUMENTS

| | | | |
|---|---|---|---|
| DE | 3837839 | A1 | 6/1989 |
| DE | 3927400 | A1 | 2/1991 |
| DE | 4229559 | A1 | 3/1994 |
| DE | 4240273 | A1 | 6/1994 |
| DE | 19631185 | A1 | 2/1998 |
| DE | 102005007997 | B3 | 12/2005 |
| DE | 102004039174 | A1 | 2/2006 |
| DE | 102004062931 | A1 | 7/2006 |
| EP | 1577634 | A1 | 9/2005 |
| GB | 1 535 733 | | 12/1978 |

OTHER PUBLICATIONS

Office Action issued in corresponding German patent application 10 2007 039 662.9 on Apr. 8, 2014.

* cited by examiner 1
2
4
5
6
7
7

PROPELLANT CHARGE IGNITER

This is a National Phase Application in the United States of International Patent Application No. PCT/EP2008/006106 filed Jul. 25, 2008, which claims priority on German Patent Application No. 10 2007 039 662.9, filed Aug. 22, 2007. The entire disclosures of the above patent applications are hereby incorporated by reference.

FIELD OF THE INVENTION

The invention relates to a propellant charge igniter with a sleeve base that is more cost-effective in terms of manufacturing cost, and the invention relates to a production method for a propellant charge igniter tube for the propellant charge igniter as well as to a method for the production of the propellant charge igniter.

BACKGROUND OF THE INVENTION

A propellant charge igniter projecting into a propellant charge is known from DE 35 12 942 A1. According to DE 38 37 839 A1, a propellant charge sleeve provided with a porous shaft is disclosed. DE 42 29 559 C2 concerns a sleeve base for a large-caliber munition.

DE 196 31 185 A1 discloses a propellant charge igniter with an igniter tube. A further propellant charge igniter is described in DE 10 2004 039 174 A1. A cartridge that contains a propellant charge igniter is known from DE 10 2004 062 931 A1.

According to prior art, the propellant charge igniter is produced as a separate assembly and built into the cartridge. As a rule, this takes place with vulcanized material coatings and with thick tubes. The disadvantage here is not only that these assemblies are expensive, but in a combat- or drill situation, after the sleeve base has been ejected, the hot propellant charge igniter tubes can ignite the combustible sleeve of a further cartridge lying in readiness. Another disadvantage is due to the flaking of the vulcanized material, which is not always reproducible. In addition, there are sealing problems against diffusing explosive oil, or the like.

Thus, the object of the invention is, in particular, to remedy these disadvantages.

SUMMARY OF THE INVENTION

The object of the invention is achieved by the features of first, fourth and fifth embodiments of the invention. Additional advantageous embodiments are also described.

Thus, in accordance with the present invention, the first embodiment pertains to a propellant charge igniter (1) provided with a sleeve base (6) and a propellant charge igniter tube (2), having outwards-orientated edges (3) that have been produced during hydroforming, through which a reproducible flaking of the opening sites in the vulcanized material (7) is ensured. In accordance with a second embodiment of the present invention, the first embodiment is modified so that the propellant charge igniter tube (2) has a larger diameter in the end area (5) than over its length and has a pressed tube end (4) in the front area. In accordance with a third embodiment of the present invention, the first embodiment and the second embodiment are further modified so that the propellant charge igniter tube (2) is connected to the sleeve base (6) via friction welding.

In accordance with a fourth embodiment of the present invention, a method for the production of a propellant charge igniter tube (2) for a propellant charge igniter (1) is provided, characterized in that the propellant charge igniter tube (2) is produced by means of hydroforming, wherein the method employs the following steps: (a) the propellant charge igniter tube (2) is inserted into a cutting die, wherein the die has cutting edges on the circumference of the inner bore, in the shape of the bore pattern/holes; (b) in the rear area of the die, stamps come together and press the tube end (4), wherein the stamps maintain the pressing pressure; (c) hydraulic fluid is injected under high pressure from the other side by means of a suitable sealing; (d) by increasing the pressure, the propellant charge igniter tube (2) is deformed and bears against the contour of the die; (e) through a further increase in the pressure, the material is sheared off in the area of the bores; and (f) an edge (3) is formed on the propellant charge igniter tube (2) on the outside.

In accordance with a fifth embodiment of the present invention, a method for the production of a propellant charge igniter (1) according to the first embodiment, the second embodiment, or the third embodiment is provided, characterized in that the propellant charge igniter tube (2) is connected to the sleeve base (6) by means of friction welding and benites (8) are pushed into the propellant charge igniter tube (2) and fixed with the already mounted lower part 9 of the propellant charge igniter 1. In accordance with a sixth embodiment of the present invention, the fifth embodiment is modified so that the fixing takes place by screwing into the sleeve base (6).

The basic concept of the invention is to produce the propellant charge igniter tube (e.g., TLanz tube) by means of hydroforming (high-pressure forming). A device of this type is described, for example, in DE 10 2005 007 997 B3. In hydroforming in the present variant, several operations are combined in order to save manufacturing time. In development of the basic concept, the sleeve base is then joined to the propellant charge igniter tube, for example, by friction welding and is vulcanized without reworking. In this context, the rubber lips of the sleeve base and the propellant charge igniter tube are molded on, or vulcanized on, in one operation. The vacuum-packed benite, and the lower part of the propellant charge igniter, can subsequently be mounted in the sleeve base.

Not only are production costs conserved, in accordance with the present invention, but also seal tightness problems are solved because, e.g., screw connections etc. are omitted. In the production of the propellant charge igniter tube, outwards-orientated edges are formed that act as predetermined breaking points for the vulcanized material when the propellant charge igniter is ignited, or during the build-up of pressure. This ensures a reproducible flaking of the aperture sites in the vulcanized material. Moreover, a durable connection is created by the friction welding of a larger tube diameter on the sleeve base. During hydroforming, the propellant charge igniter tube undergoes a cold-work hardening. As a result, it becomes more durable than conventional propellant charge igniter tubes, wherein also the fact that the goal is a larger diameter in the lower area of the propellant charge igniter tube plays a not inconsiderable role. In addition, an otherwise necessary lid on the propellant charge igniter tube, disposed by a pressing procedure as part of the hydroforming, can be omitted. Furthermore, the complete sealing of the propellant charge igniter against water and explosive oil is ensured.

BRIEF SUMMARY OF THE DRAWINGS

The invention is to be described in more detail on the basis of an exemplary embodiment, illustrated with drawings, which show.

DETAILED DESCRIPTION OF THE INVENTION

Figure 1:
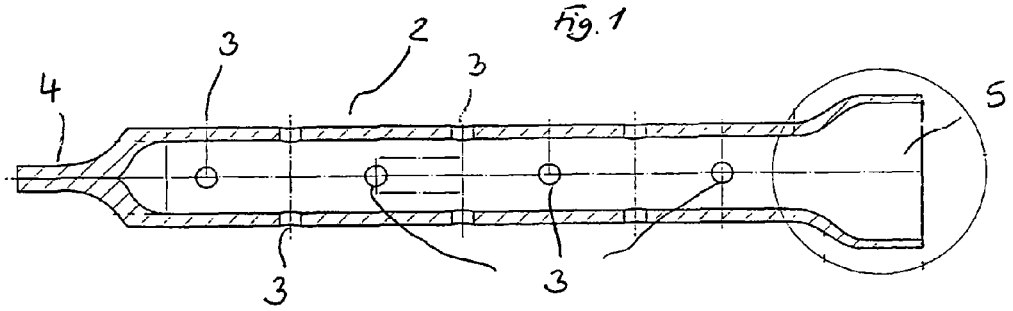
FIG. 1 shows a propellant charge igniter tube produced according to hydroforming of the invention.

FIG. 1 shows a propellant charge igniter tube 2 as part of a propellant charge igniter 1, (see FIG. 4), provided with an outwards-orientated edge 3 inserted around the circumference.

Figure 2:
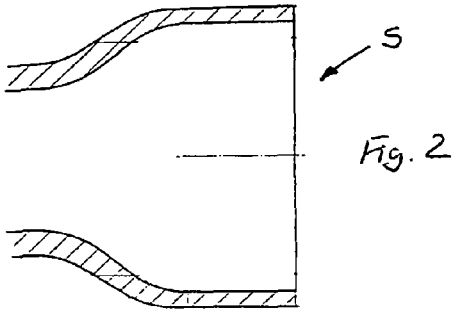
FIG. 2 illustrates an enlarged representation from FIG. 1.

The propellant charge igniter tube 2 has been produced by hydroforming. In this process of hydroforming, the tube 2 was inserted into a cutting die (not shown in more detail). The starting point is a conventional, and thus known, cutting die. In the rear area of the die, stamps come together and press the tube end 4. The stamps maintain the pressing pressure, or are blocked in their position mechanically. From the other side, by means of suitable sealing, hydraulic fluid is injected in under high pressure. On the circumference of the inner bore 11, the die has cutting edges in the form of the bore pattern/holes. Through an increase in pressure, the tube 2 is deformed and bears against the contour of the die. Through a further increase in the pressure, the material is sheared off in the area of the bores. Edge 3 is formed outwards 12. The cutting die should be constructed such that the pressure does not fall when a bore 11 is stamped out in the tube 2. At the end 5, the tube 2 preferably has a larger diameter (FIG. 2).

Figure 3:
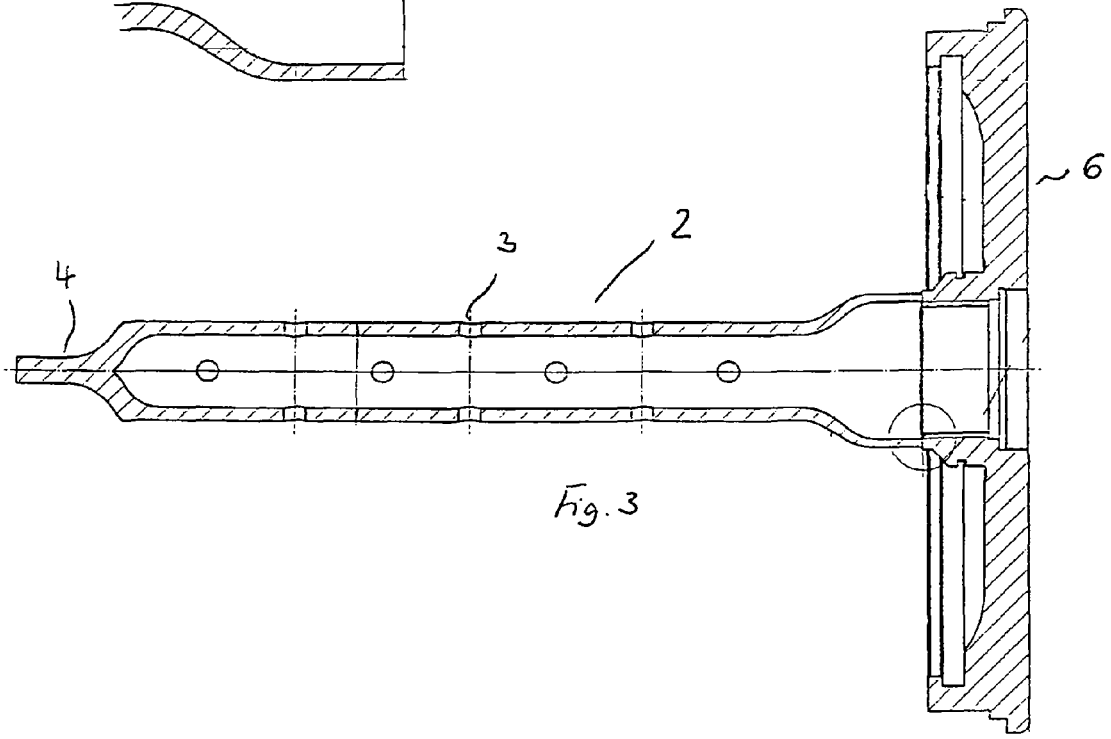
FIG. 3 shows the propellant charge igniter tube provided with a friction welding to the sleeve base.

In the following operation, this tube 2 is then joined at the end 5 to a sleeve base 6, preferably by means of friction welding (FIG. 3). The friction welding should be designed so that a reworking of the joint sites is not required. The larger diameter at the end 5 effects a better connection between tube 1 and sleeve base 6.

Figure 4:
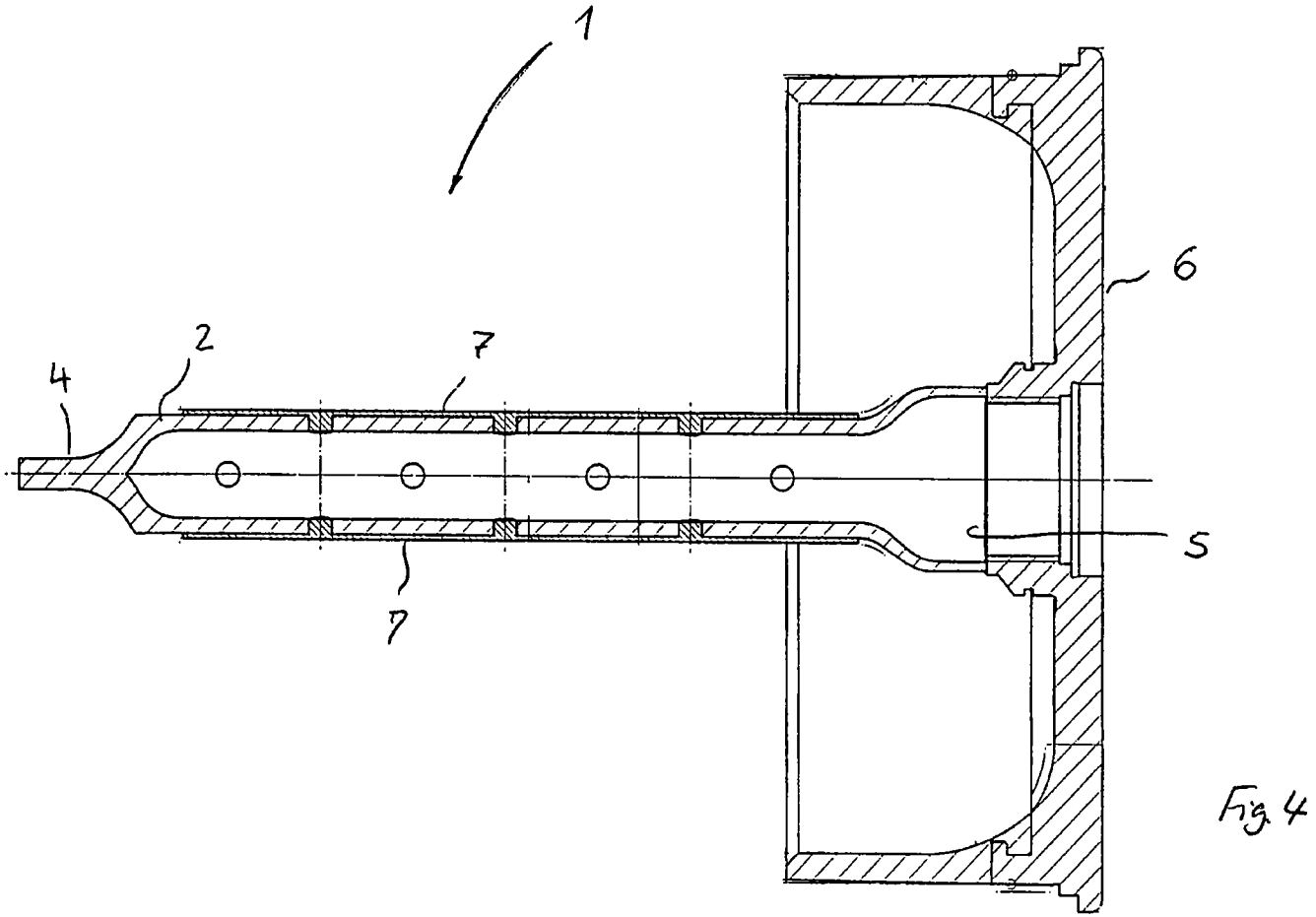
FIG. 4 shows the propellant charge igniter tube with sleeve base—vulcanized.

Subsequently, the vulcanization of a rubber lip and the vulcanized coating 7 of the tube 2 take place with a vulcanization tool (not shown in more detail), as can be seen in FIG. 4.

Figure 5:
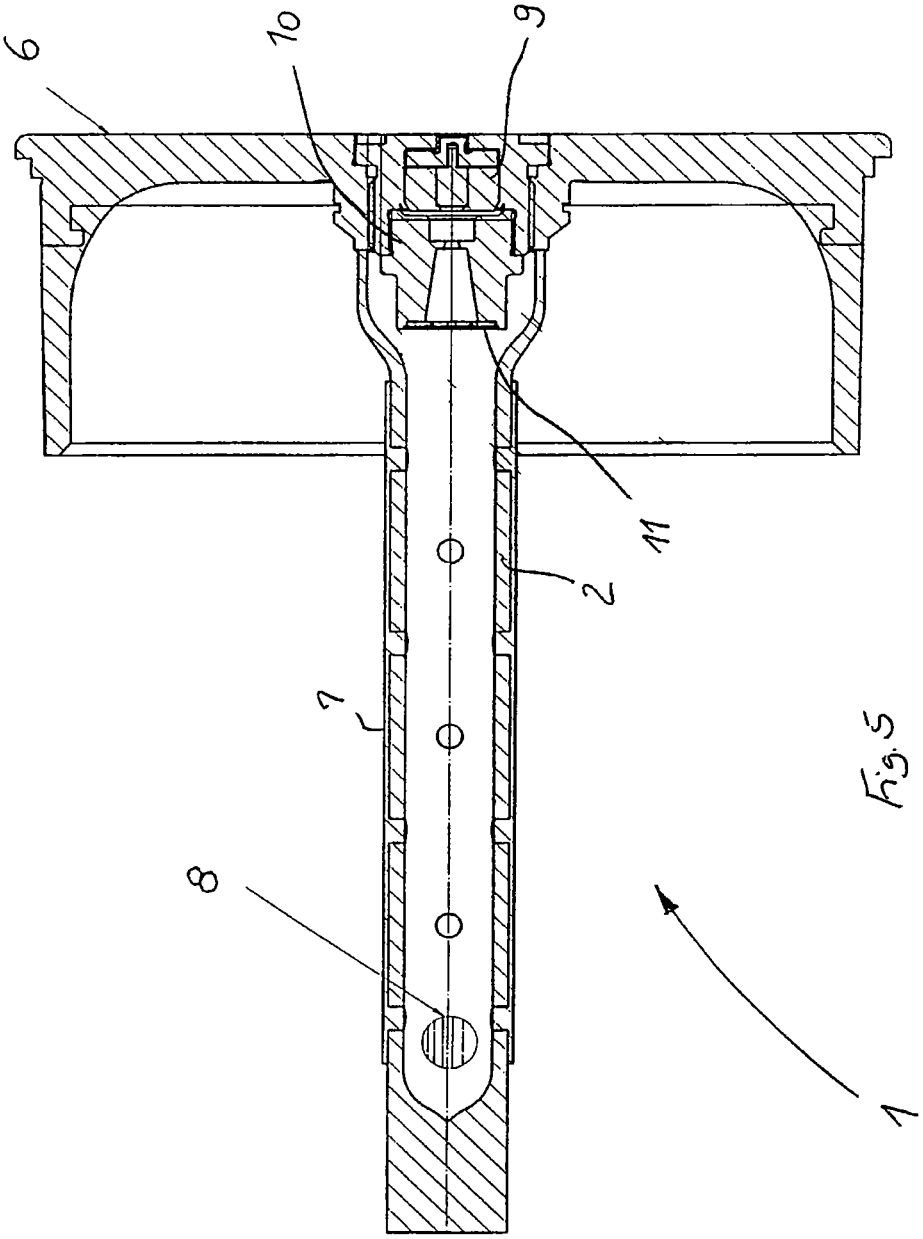
FIG. 5 shows the propellant charge igniter with sleeve base—complete.
Figure 6:
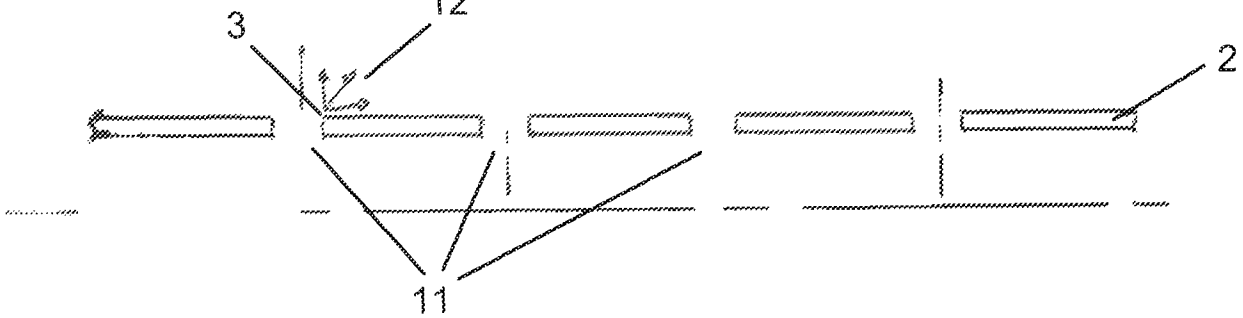
FIG. 6 illustrates the outwardly oriented edges disposed in bores.

Benite 8, as delivered vacuum-packed, is pushed into the tube 2 and fixed with the already mounted lower part 9 of the propellant charge igniter 1 (for example, by screwing into the sleeve base 6). The adapter part 10 of the propellant charge igniter 1 is likewise modified. The screen disk 11 is joined to the adapter piece 10 by a pressing procedure (FIG. 5).

The invention claimed is:

1. A propellant charge igniter comprising:

(a) a sleeve base;

(b) a propellant charge igniter tube connected to the sleeve base, wherein the propellant charge igniter tube has a plurality of bores on an outer periphery of the propellant charge igniter tube, wherein each bore has an outwardly oriented edge, and wherein the outwardly oriented edges are formed during hydroforming of the bores; and (c) a vulcanized material coating on an external surface of the propellant charge igniter tube, wherein the vulcanized material coating includes portions disposed in the bores, and wherein the outwardly oriented edges are formed to locally weaken and facilitate breakage of the vulcanized material coating and ensure a reproducible flaking of the vulcanized material coating from the propellant charge igniter tube;

wherein the propellant charge igniter tube is connected to the sleeve base via friction welding.

2. The propellant charge igniter according to claim 1, wherein the propellant charge igniter tube has a diameter at an end area larger than a remaining length of the tube, and the propellant charge igniter tube has a pressed tube end at a front area of the tube.

3. A method for the production of a propellant charge igniter tube for a propellant charge igniter, the method comprising the steps of:

(a) inserting an uncut propellant charge igniter tube into a cutting die, wherein the die has cutting edges on a circumference of an inner bore, wherein the cutting edges are in shapes of bore pattern holes;

(b) bringing stamps together in a rear area of the die and pressing a first tube end of the uncut propellant charge igniter tube, wherein the stamps maintain a pressing pressure that presses the first tube end of the uncut propellant charge igniter tube;

(c) injecting hydraulic fluid under high pressure from a second tube end of the uncut propellant igniter tube by means of a sealing;

(d) deforming the uncut propellant charge igniter tube by increasing pressure inside the uncut propellant charge igniter tube so that the uncut propellant charge igniter tube bears against a contour of the die and bores are formed on an outer periphery of the uncut propellant charge igniter tube;

(e) producing a cut propellant charge igniter tube by shearing off materials in areas of the bores by further increasing the pressure inside the uncut propellant igniter tube; and (f) forming an outwardly oriented edge in each of the bores on an outside circumference of the cut propellant charge igniter tube so that the outwardly oriented edge acts as a predetermined breaking point in the vulcanized material coating.

4. A method for the production of a propellant charge igniter, the method comprising the steps of:

(a) providing a sleeve base;

(b) providing a propellant charge igniter tube made according to the method of claim 3, wherein the propellant charge igniter tube has outwardly oriented edges on an outside circumference of the propellant charge igniter tube;

(c) connecting the propellant charge igniter tube to the sleeve base by means of friction welding;

(d) forming a vulcanized material coating on an exterior of the propellant charge igniter tube, wherein the outwardly oriented edges are formed to act as predetermined breaking points in the vulcanized material coating;

(e) pushing a pyrotechnical material into the propellant charge igniter tube; and (f) fixing the pyrotechnical material within the propellant charge igniter tube using a lower part of the propellant charge igniter.

5. The method according to claim 4, wherein the pyrotechnical material is fixed with the lower part comprises by screwing the lower part into the sleeve base.

6. A method for making a propellant charge igniter, the method comprising the steps of:

(a) providing a sleeve base;

(b) providing a propellant charge igniter tube made according to the method of claim 3, wherein the propellant charge igniter tube has (i) outwardly oriented edges on an outside circumference of the tube;

(ii) a diameter at an end area larger than a remaining length of the tube; and (iii) a pressed tube end at a front area of the tube;

(c) connecting the propellant charge igniter tube to the sleeve base by means of friction welding, (d) forming a vulcanized material coating on an exterior of the propellant charge igniter tube, wherein the outwardly oriented edges are formed to act as predetermined breaking points in the vulcanized material coating;

(e) pushing a pyrotechnical material into the propellant charge igniter tube; and (f) fixing the pyrotechnical material with an already mounted lower part of the propellant charge igniter.

7. The method according to claim 6, wherein the pyrotechnical material is fixed with the lower part by screwing the lower part into the sleeve base.

8. The method according to claim 4, wherein the pyrotechnical material comprises benite.

9. The method according to claim 6, wherein the pyrotechnical material comprises benite.

10. The propellant charge igniter of claim 1, further comprising:

(d) an adapter part with a screen disk.

* * * * *